US011410527B2

(12) United States Patent
Baumgartner et al.

(10) Patent No.: US 11,410,527 B2
(45) Date of Patent: Aug. 9, 2022

(54) METHOD AND SYSTEM FOR SOCIAL DISTANCE MONITORING, ALERTING AND REPORTING USING A COMBINATION OF ULTRASONIC TRANSPONDERS AND A WIRELESS RF DATA NETWORK

(71) Applicants: Michael Baumgartner, Panama City, FL (US); Eugene Rohling, Atlanta, GA (US); Brian Donlan, Panama City, FL (US); Ira Lehrman, Panama City, FL (US); Randall Shepard, Panama City, FL (US)

(72) Inventors: Michael Baumgartner, Panama City, FL (US); Eugene Rohling, Atlanta, GA (US); Brian Donlan, Panama City, FL (US); Ira Lehrman, Panama City, FL (US); Randall Shepard, Panama City, FL (US)

( * ) Notice: Subject to any disclaimer, the term of this patent is extended or adjusted under 35 U.S.C. 154(b) by 0 days.

(21) Appl. No.: 17/340,096

(22) Filed: Jun. 7, 2021

(65) Prior Publication Data

US 2021/0383671 A1 Dec. 9, 2021

Related U.S. Application Data

(60) Provisional application No. 63/036,375, filed on Jun. 8, 2020.

(51) Int. Cl.

| | |
|---|---|
| ***G08B 21/22*** | (2006.01) |
| ***G08B 25/10*** | (2006.01) |
| ***G08B 25/00*** | (2006.01) |
| ***G08B 21/18*** | (2006.01) |

(52) U.S. Cl.

CPC ..... *G08B 21/22* (2013.01); *G08B 21/182* (2013.01); *G08B 25/007* (2013.01); *G08B 25/10* (2013.01)

(58) Field of Classification Search

CPC ..... G08B 21/22; G08B 21/182; G08B 25/07; G08B 25/10

See application file for complete search history.

(56) References Cited

U.S. PATENT DOCUMENTS

| | | | | |
|---|---|---|---|---|
| 10,432,569 | B2 * | 10/2019 | Horie | H04W 68/00 |
| 10,915,231 | B1 * | 2/2021 | Bacon | G06F 3/0482 |
| 2015/0262134 | A1 * | 9/2015 | Daley | G06Q 10/20 705/305 |
| 2021/0319675 | A1 * | 10/2021 | Bitetto | F21V 14/02 |
| 2021/0327240 | A1 * | 10/2021 | Cook | G08B 21/02 |

* cited by examiner

*Primary Examiner* — Ojiako K Nwugo

(74) *Attorney, Agent, or Firm* — Woodruff & Black, LLC; Paden E. Woodruff, IV

(57) ABSTRACT

A method for monitoring and reporting personnel social distancing practices using a small personnel monitoring and alerting device incorporating ultrasonic sensors to monitor a complete 360-degree field of view around each wearer in the workplace. The monitoring and alerting devices monitor the distance between personnel wearing the device at preset time intervals using ultrasonic sensors and provides an individual alert (visual, buzzer, and/or vibration) to any wearers that are encroaching within a preset distance of another person wearing the device. Device reports via a RF network to a second device and/or centralized data center on each encroachment and unencroachment event.

5 Claims, 6 Drawing Sheets

METHOD AND SYSTEM FOR SOCIAL DISTANCE MONITORING, ALERTING AND REPORTING USING A COMBINATION OF ULTRASONIC TRANSPONDERS AND A WIRELESS RF DATA NETWORK

CROSS-REFERENCES TO RELATED APPLICATIONS

This application claims the benefit of U.S. Provisional patent application Ser. No. 63/036,375 filed Jun. 8, 2020 and entitled A METHOD AND SYSTEM FOR SOCIAL DISTANCE MONITORING, ALERTING AND REPORTING USING A COMBINATION OF ULTRASONIC TRANSPONDERS AND WIRELESS RF DATA NETWORK

STATEMENT REGARDING FEDERALLY SPONSORED RESEARCH OR DEVELOPMENT

Not applicable.

MICROFICHE APPENDIX

Not applicable.

BACKGROUND

As a result of a global pandemic, businesses are struggling to provide a safe workplace environment while still being able to function and continue to produce goods and services. In order to provide a safe workplace environment, employers are instituting the Centers for Disease Control (CDC) guidelines for Social Distancing and Contact Tracing while maintaining wearer confidentiality. Employers need tools and devices that monitor, alert and log wearer social distancing practices, identify separation policy violations, tracking encroachment participants, and monitor and log the wearers in each other's workspace environment.

Early attempts at monitoring social distancing using Bluetooth and other Radio Frequency (RF) based Receiver Signal Strength Indicator (RSSI) devices have failed due to the inherently inaccurate nature of this method. As such, accurate and reliable devices are needed to meet these unfulfilled requirements.

This embodiment uses a novel combination of ultrasonic and RF sensors to constantly monitor the workplace for personal Social Distance Monitoring (SDM) separation issues.

SUMMARY OF INVENTION

In one embodiment, a method is disclosed for monitoring and reporting personnel social distancing practices. A small personnel monitoring and alerting device is provided to each wearer to wear in the workplace. The monitoring and alerting device: 1. Monitors, at preset time intervals, the distance between personnel wearing the device (wearer); 2. Provides an individual alert (visual, buzzer, and/or vibration) to any wearers that are, in a preferred embodiment, within six feet of each other, however other preset distances can be set within a range of less than a meter to over 20 meters; 3. Reports to a second device and/or centralized data center on each SDM separation infringement (encroachment) event; and 4. Incorporates ultrasonic sensors to monitor a complete 360-degree field of view around each wearer.

The monitoring and alerting devices use a combination of ultrasonic and RF sensors to constantly measure wearer separation. The monitoring and alerting devices: 1. Measure accurate short-range distances between wearers of between zero and seven feet with three inches of accuracy; 2. Measure general wearer separations of seven feet to fifty feet with 10 feet accuracy; 3. Automatically form a two-way, ad hoc, self-healing wireless communications mesh network comprising one or more of the actions of: a. Reporting encroachment events by wearers; b. Reporting end of encroachment events by wearers; c. Sending a page-notice to a specific wearer (single-cast), a group of wearers (multicast) or all wearers (broadcast) causing a unique pattern of device alert flashing, buzzing and vibration associated with the alert meaning; d. Reporting an immediate-attention alert from a wearer by a unique tap pattern on the device; e. Reporting an immediate-attention alert based on free-fall, shock and tilt detection by the accelerometer in the SDM device associated with a fall by the wearer; f Reporting an automatic rollcall of wearers at a designated location, like an evacuation muster location by acknowledging receipt of a unique muster-site location beacon; and g. Remotely managing device configurations by sending single cast, multicast or broadcast configuration messages to devices including firmware updates.

A cloud-based SDM Monitoring Data Center or second computing device is used to: 1. Log and report each alert message of an SDM encroachment start event and end of encroachment event; 2. Correlate each event with the specific wearers involved; and 3. Provide a connection and reports to the Business Operations Center.

DETAILED DESCRIPTION

In the following description, numerous specific details are set forth in order to provide a thorough understanding of the present invention. It will be apparent, however, to one skilled in the art that the present invention may be practiced without some of these specific details. In other instances, well known process operations have not been described in detail in order not to unnecessarily obscure the present invention.

In one embodiment, a system and method are disclosed for monitoring and reporting wearer social distance policy compliance.

The Invention comprises the following key features: 1. A battery-powered personnel monitoring and alerting device with a unique identifier (ID) is provided to participating personnel; 2. The personnel device uses LED, buzzer, and/or vibration to alert a wearer that they are involved in an encroachment event; 3. The personnel device, in a preferred embodiment, encrypts event data that it stores within the device; 4. The data that is transmitted across the RF and internet communications networks is, in a preferred embodiment, encrypted; 5. The personnel device uses ultrasonic transponders to measure the zero to seven-foot distance between devices; 6. The personnel devices also include an RF wireless radio/modem that is used to form a two-way communication network that can communicate with and report between an SDM Monitoring Data Center and personnel devices; 7. The personnel device's RF wireless radio/modem is also used to form an inter-device RF beaconing system to identify and report other personnel devices in the vicinity of approximately fifty feet; 8. An on-location RF network gateway is used to connect the personnel device RF wireless communications network to the SDM Monitoring Data Center; 9. The system incorporates a cloud-based SDM Monitoring Data Center that correlates the short-range encroachment events with the RF beaconing data to identify the device IDs of the encroachment event; 10. The SDM Monitoring Data Center or second computing device comprises a database that correlates personnel device IDs with the wearer's ID. The database or second computing device, in a preferred embodiment, utilizes well known encryption methods to protect wearer data; and 11. The SDM Monitoring Data Center or second computing device reports regularly to the Businesses Data Center on the system health and status, and a report on each encroachment event and end of encroachment message.

Figure 1:
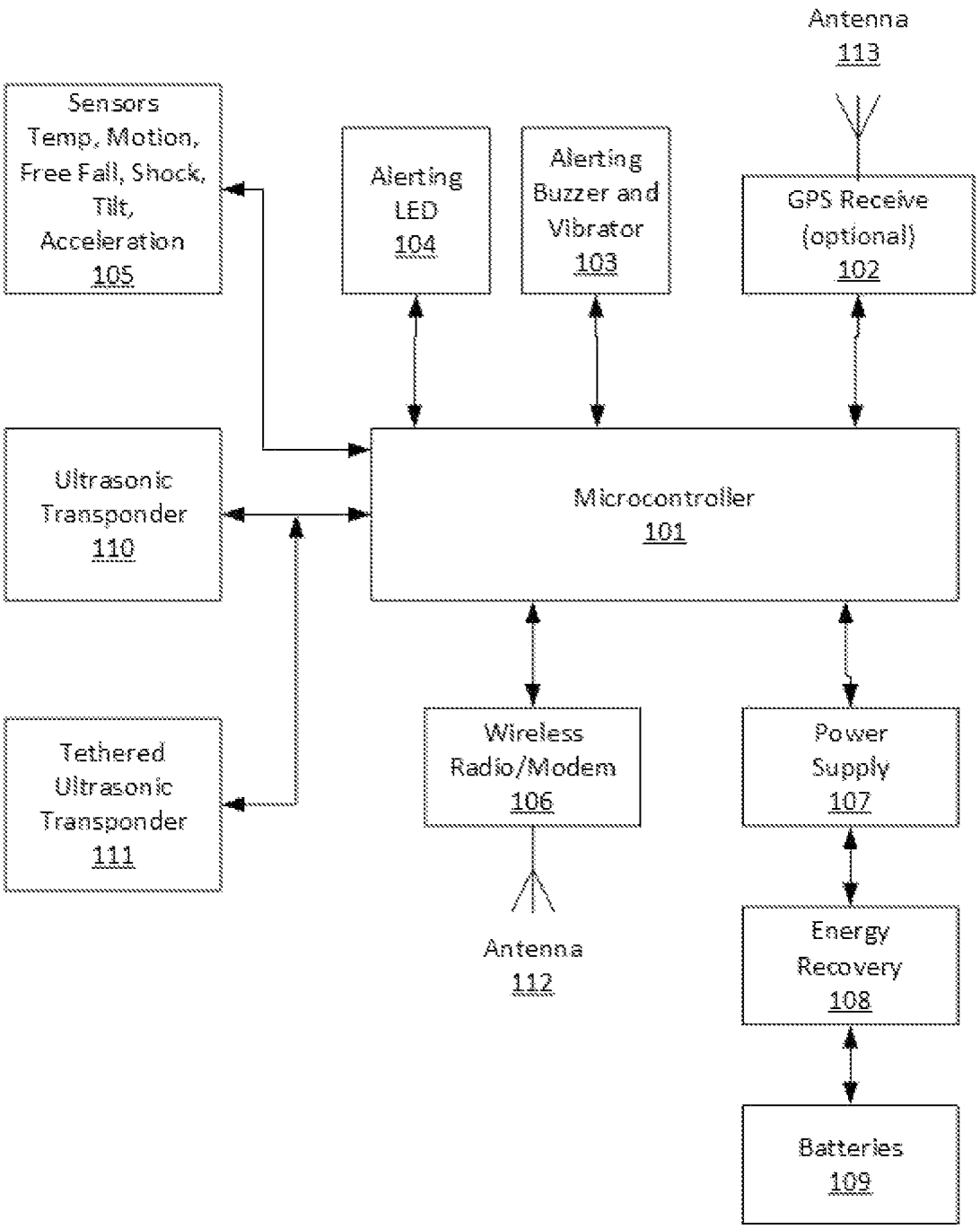
FIG. 1 is an illustration showing a schematic of the personnel monitoring and alerting device, in accordance with one embodiment of the present invention.

As shown in FIG. 1, the personnel device will utilize an embedded microcontroller 101, ultrasonic transponders 110-111 and an RF wireless radio/modem 106 to determine and report wearer encroachment events, end of encroachment and devices in the vicinity. The personnel device incorporates both a visual indicator 104 and/or a buzzer/vibrator 103 alerting the wearer if the separation distance policy is violated.

The personnel device is battery powered 107-109; as a result, the device's microcontroller 101 and associated circuitry is optimized for low power operation. Optionally, the wearer's position can also be logged using a GPS receiver 102. Additional sensors can be included to monitor and log the wearer's working environment and movements 105.

The personnel device regular reports its health, battery state and status to the SDM Monitoring Data Center via the RF network 106.

Experiments have shown that depending solely on received RF signal strength (RSSI) is not a suitable method to accurately and reliably determine the distance between RF communicating devices, especially in the three to ten-foot range. Therefore, a novel method is used that combines the RF received signal strengths with ultrasonic sensor distance measurements. Each device uses on-board ultrasonic ranging transponders to detect another device and calculate the exact distance it is from that device. Specifically, it accurately knows the time of the encroachment and the exact distance to the other encroaching devices.

In this embodiment, the personnel device (FIG. 1) utilizes two ultrasonic sensors 110-111 with one attached on the front and the other on the back of each wearer. The ultrasonic sensors employ a unique communication schema to determine the distance between ultrasonic sensors. They use the time-of-flight (TOF) between a transmitter and a receiver to measure the distance between devices with an accuracy within a few inches.

Since the ultrasonic transponder does not transmit any type of identifier, the identity of the encroaching device is not immediately known at time of encroachment detection. The SDM Monitoring Data Center's or second computing device's correlation algorithms are used to match the event time and distance of ultrasonic event reports to generate encroachment pairs and un-paired encroachments. The customer's Business Operations Center merges encroachment device IDs with personally identifiable information.

Figure 2:
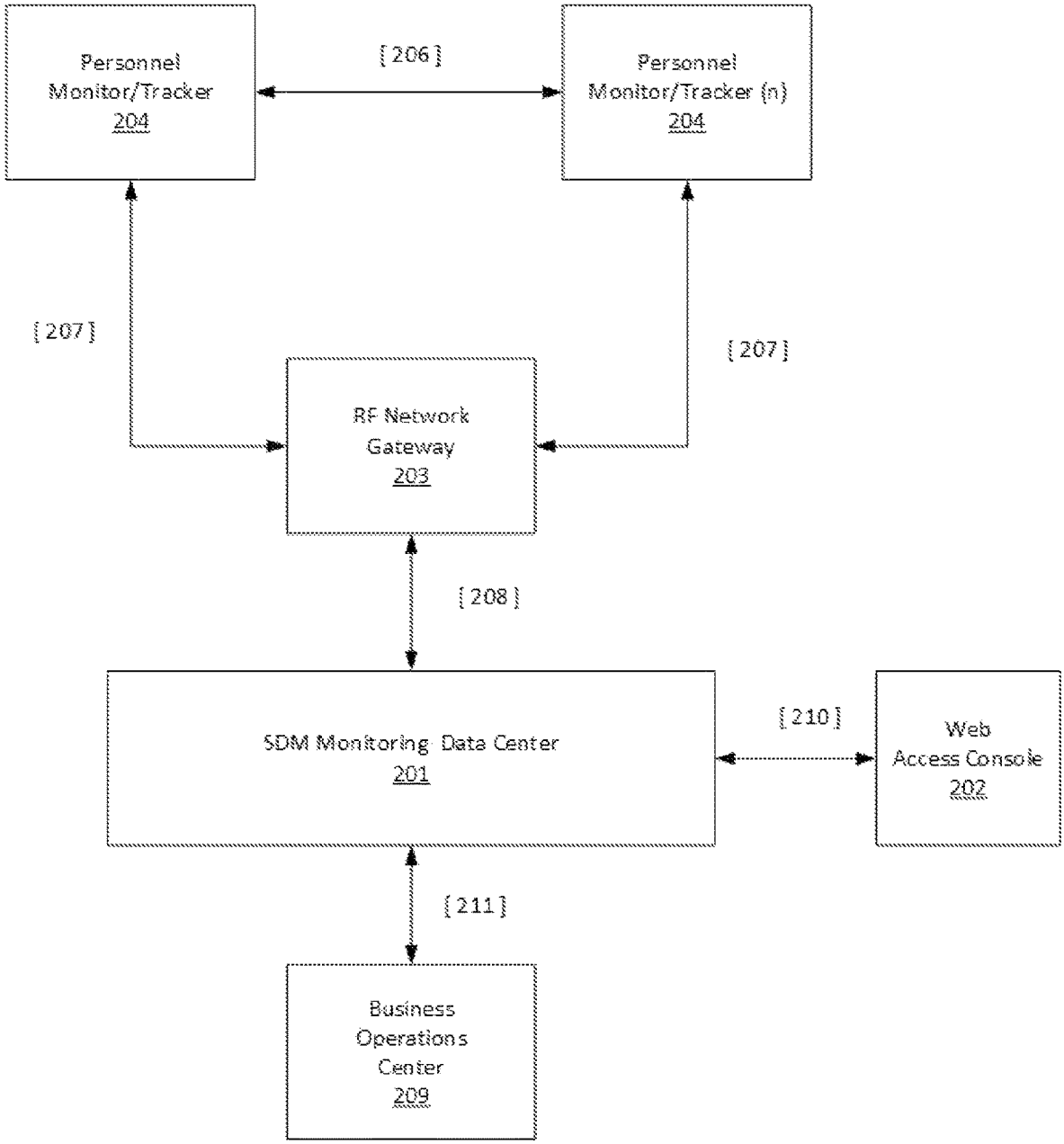
FIG. 2 shows a system in which the Social Distance Monitoring (SDM) system capability is defined and further shows multiple personnel monitoring and alerting devices communicating with a RF network gateway connected via internet to a cloud-based SDM Monitoring Data Center or second computing device which in turn, in a preferred embodiment, transmits data to a Business Operations Centers, in accordance with one embodiment of the present invention.

In FIG. 2, each of the Personnel Monitor/Tracker devices 204 is equipped with an RF wireless radio/modem 106 that is used for both two-way data communication and as an RF beaconing system 206. In the preferred embodiment, the RF radio/modems are used to form a wireless communications mesh network that automatically authenticates and links with its neighbors to form a resilient, robust wireless communications mesh network, ultimately with the SDM Monitoring Data Center via a RF wireless communications mesh network data gateway 203. Alternatively, the RF radio/modems could be used to from a star network topology. The star network would support a significantly smaller device wearer work area than the wireless communications mesh network would. The mesh network can be easily extended and enhanced by pre-provisioning any RF blind spots and links between RF isolated device-wearer work areas with fixed mesh network repeater nodes that easily expand the wireless communications mesh network coverage area.

The RF network gateway provides a bridge between the device communication network 207 and the SDM Monitoring Data Center. The RF network gateway can use a combination of Ethernet, WIFI, or cellular connection to communicate with the SDM Monitoring Data Center or second computing device 208.

The RF communication mesh network 207 is enhanced by the addition of an RF beaconing method that can determine approximate distances between devices. On a periodic basis, each device broadcasts an RF beacon that is received by nearby devices. Each time a device receives a broadcast beacon, it reports this reception to the SDM Monitoring Data Center or second computing device. This report comprises sending device ID, receiving device ID, received time, and received signal strength. These reports enable the SDM Monitoring Data Center or second computing device to identify the network devices and their relative distances. The SDM Monitoring Data Center or second computing device correlation algorithm utilizes this data to identify each encroachment device.

In a more complex embodiment, multiple devices are in the vicinity of each other such that the RF beaconing network information is used to determine which devices are in close physical proximity. This information is used to help correlate the ultrasonic encroachment reports.

Figure 3:
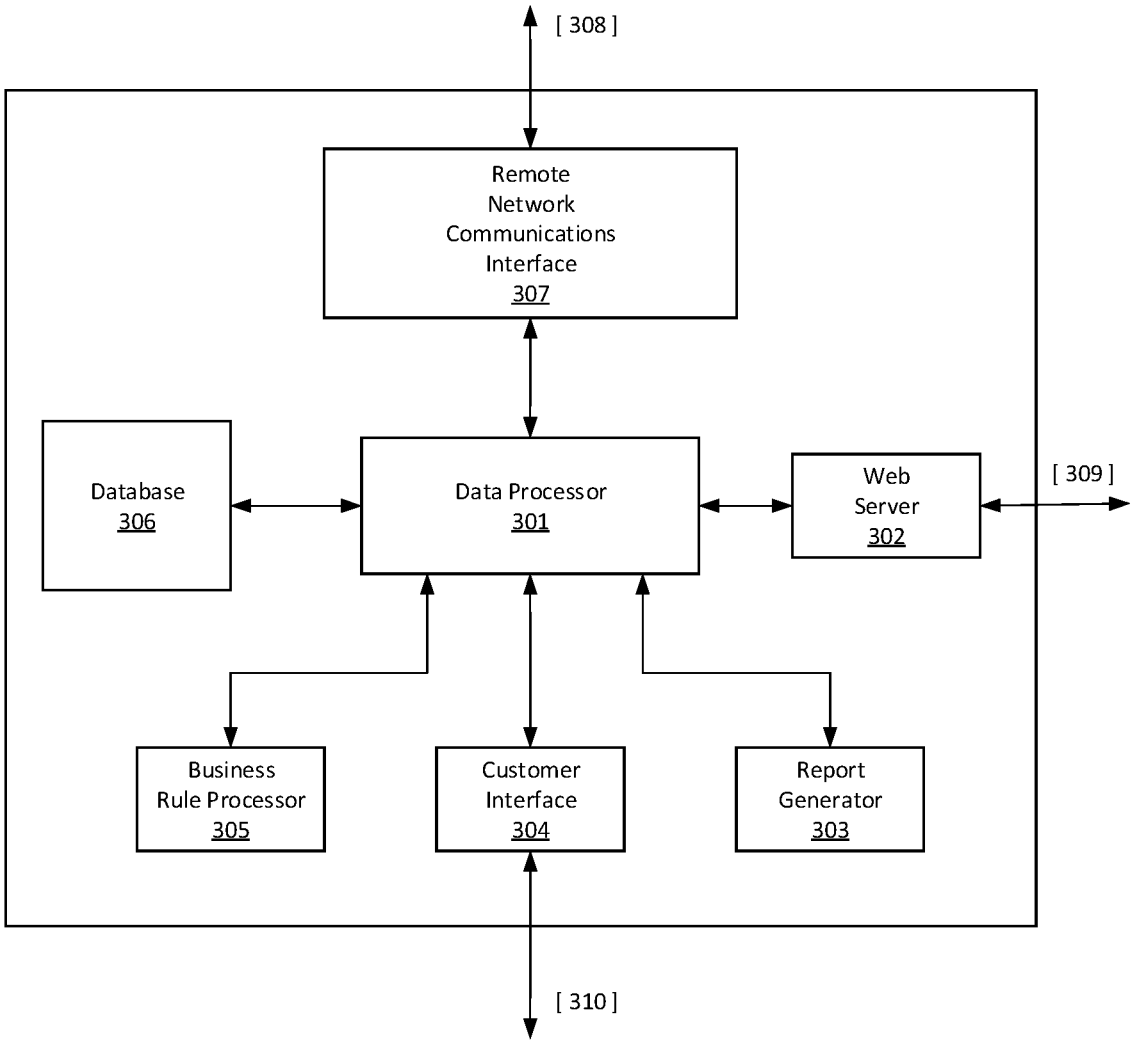
FIG. 3 is an illustration showing a block diagram of the cloud-based SDM Monitoring Data Center of FIG. 2, in accordance with one embodiment of the present invention.

The Monitoring Data Center (FIG. 3) is a cloud-based server system and utilizes industry standard server technology.

The Monitoring Data Center or second computing device comprises: 1. Receiving personnel device RF beacon reception reports; 2. Receiving personnel device ultrasonic encroachment reports; 3. Correlating the encroachment reports to identify the device involved in the encroachment by using: a. Ultrasonic encroachment reports (time and distances); and b. Device RF beacon locations reports (optional); 4. Monitoring the health and status of the personnel devices; 5. Providing reports and alerts to the Business Operations Center 209/304; 6. Archiving all data (both event logs and personnel device health and status); and 7. All data stored in the SDM Monitoring Data Center or second computing device is, in a preferred embodiment, encrypted at-rest.

The SDM Monitoring Data Center or second computing device has a communications interface process 301 that receives (and sends) messaging to (and from) the personnel device RF network via the Internet and TCP/IP messaging 307/308/208. Most of the messaging traffic is from the personnel monitoring and alerting devices to the SDM Monitoring Data Center or second computing device. However, some reverse channel messaging is used to remotely configure and maintain the personnel devices as well as sending paging messages to the SDM personnel device to activate the alert LED, buzzer and/or vibrator in a fashion unique from an encroachment alert in a single-cast, multicast or broadcast fashion.

The heart of the SDM Monitoring Data Center or second computing device is the data processing process 301 that manages the data flow between each of the Monitoring processes.

The SDM Monitoring Data Center or second computing device uses an industry standard database system 304 to handle the storage and retrieval of all personnel monitoring data. The database stores the system performance and encroachment events. The database also stores the health, status, and configuration of each of the personnel devices. In a preferred embodiment, as a security measure, wearer data is not stored on the personnel devices.

The SDM Monitoring Data Center or second computing device also includes a customizable business rule processing engine 305 and a report generation engine 303 to modify the system operation, data processing, and reporting capability based on each customer's business needs.

The SDM Monitoring Data Center communicates with the Business Operations Center 209 via the Internet IP, email, or via cellphone text messages, using a customer interface process 304. In a preferred embodiment, communications via the Internet use industry standard inter-server TCP/IP protocols such as XML, SOAP or JSON 211/310.

The SDM Monitoring Data Center or second computing device also comprises a Web Server 302 used to provide a user interface to the SDM Monitoring Data Center or second computing device operation via industry standard HTTP/HTML protocols 309.

Figure 4:
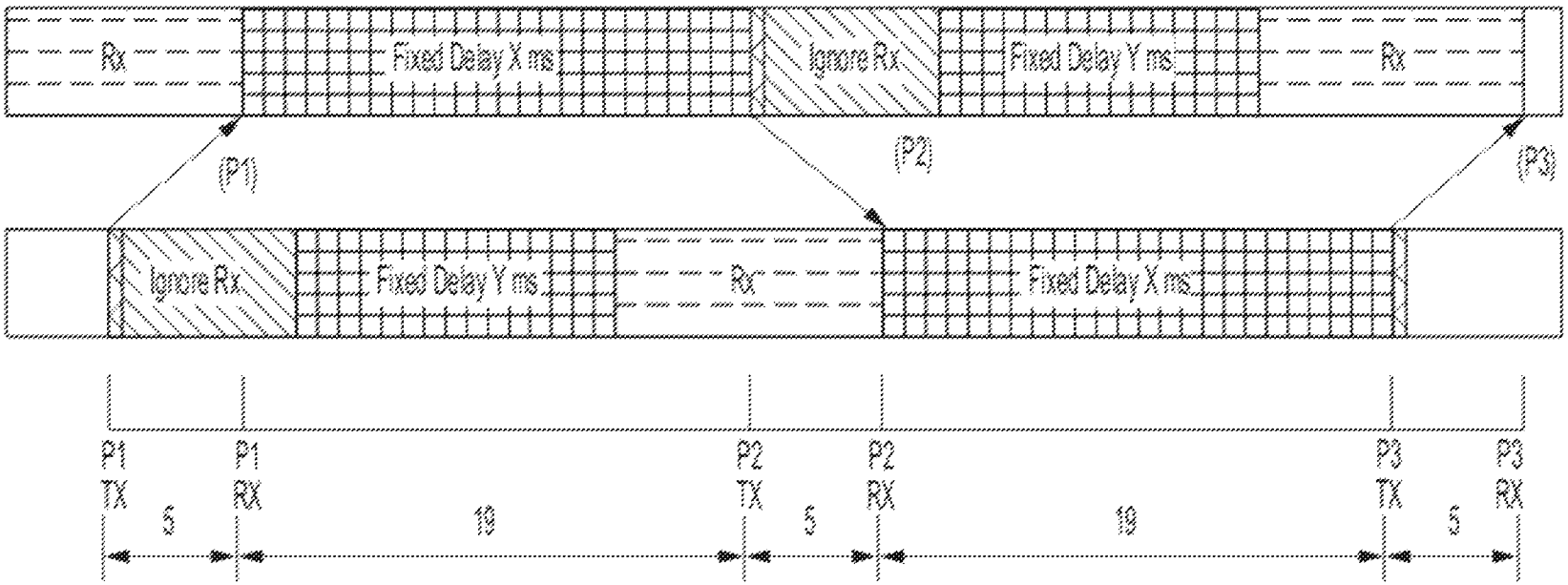
FIG. 4 is an illustration showing one embodiment using a three-pulse exchange between ultrasonic transponders.
Figure 5:
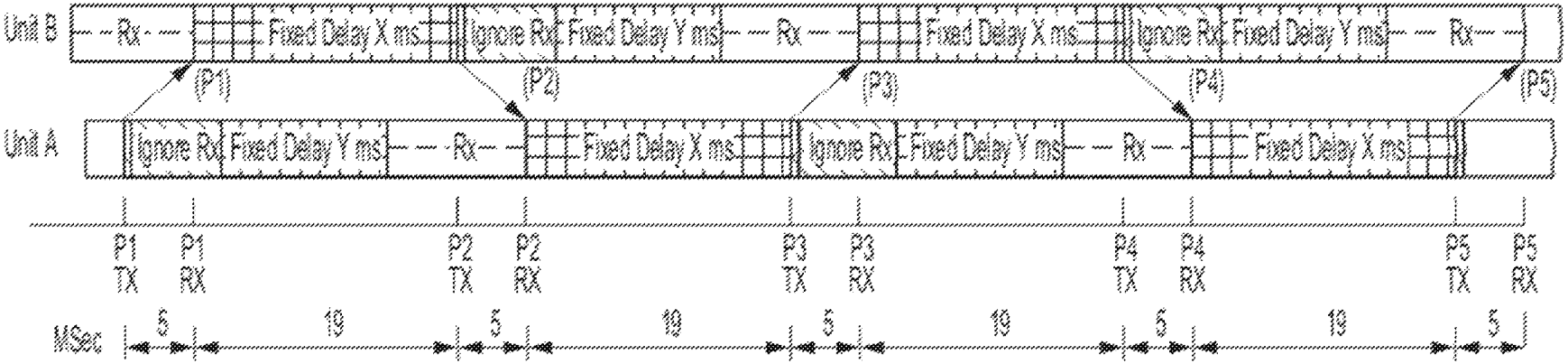
FIG. 5 is an illustration showing an alternate embodiment using a five-pulse exchange between ultrasonic transponders.
Figure 6:
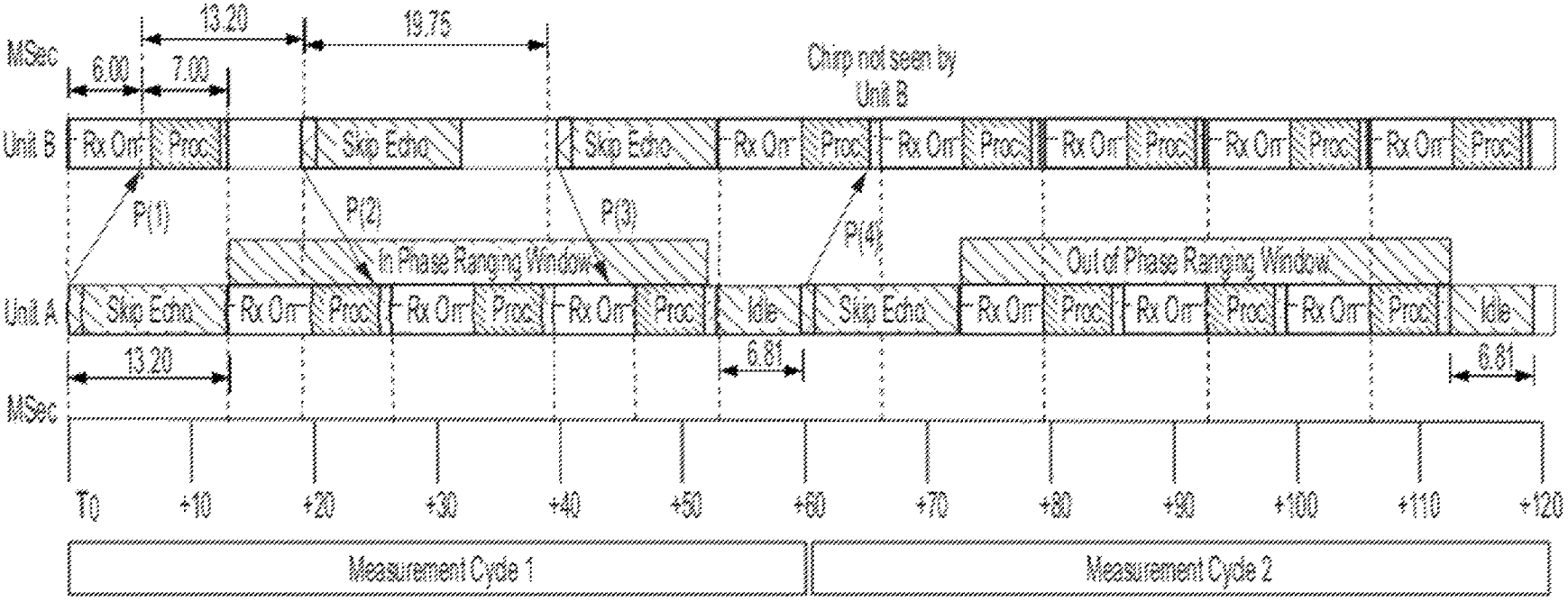
FIG. 6 is an illustration showing one embodiment using existing ultrasonic sensors that alternate receiving and processing with a 50% duty cycle.

The ultrasonic transponder is a key system component, FIGS. 4-6 present three alternate embodiments for the ultrasonic transponder configuration, usage and pulse waveforms.

The three-pulse exchange shown in FIG. 4 allows both devices to determine range during the same pulse exchange. This allows each device to include closely correlated time and range values in their reports. FIG. 4 illustrates three ultrasonic pulses used to determine the device separation. The sequence works as follows:

Periodically, in a preferred embodiment, approximately once per second, Device A will start a range measurement cycle by broadcasting a short (50-100 microsec) ultrasonic pulse (1). On receiving the ultrasonic pulse, Device B responds after a fixed, known delay with its own response pulse (2). Device A will receive the response pulse (2) and compute the distance by measuring the time between broadcast pulse (1) and received response pulse (2). Device A can determine the distance between Device A and Device B by subtracting the fixed, known delay and dividing the time of flight by two.

If Device A is less than the defined threshold, Device A will alert the wearer by means of LED flashes, vibration and/or buzzer. Using the RF network, Device A will send an encroachment report with its ID, event time and measured distance to the data center.

The encroachment report comprises the time of the encroachment and the distance measured. The defined threshold is adjustable remotely via the RF network. "six feet" is used as the nominal value.

Device A upon receiving the response pulse (2) from Device B, Device A will send another pulse (3) to Device B. Device B will use this third pulse to determine its distance from Device A by measuring the time delay between sending pulse (2) and receiving pulse (3).

If the distance measured is less than the defined threshold (six feet), Device B will alert the wearer by means of LED flashes, vibration and/or buzzer. Then, using the RF network, Device B will also send an encroachment report with its ID, event time and measured distance to the data center.

The timeframe is sufficiently short between the pulses to ensure that both devices will report an encroachment at very nearly the same time.

The five-pulse exchange shown in FIG. 5 allows both devices to increase the confidence that the ultrasonic pulse exchange was only between two devices rather than including an ultrasonic pulse from a third device. The confidence is due to Device A seeing the same range in both range measurements and Device B seeing the same range in both range measurements during the exchange.

FIG. 6 shows yet another embodiment of an ultrasonic transponder to accurately determine the distance between two transponders. In this embodiment, an off-the-shelf ultrasonic MEMs sensor is used. This sensor was designed for simple ranging applications with distances less than 3.9 feet. The device actively senses (captures) ultrasonic data in the time domain for approximately 6.8 milliseconds. This device is changed into a distance transponder with the limitation that it can only receive ranging data 50% of the time. This device alternates between capturing data for 6.8 milliseconds and processing data for 6.45 milliseconds for a total frame period of approximately 13.25 milliseconds.

In this embodiment, to compensate for the 50% duty cycle, Device A broadcasts two pulses and listens for responses during Frame 0 and Frame 4 as shown in FIG. 6. The two pulses are timed so that they are received by Device B during either Frame 0 or Frame 4 depending on the frame phasing between the two asynchronous devices. FIG. 6 illustrates this for a distance of 6.75 feet for devices that happen to be in phase or time synchronized.

When Device B receives a pulse, Device B waits exactly 13.2 milliseconds and then responds with two broadcast pulses timed 19.75 milliseconds apart. These pulses are received by Device A during one of two "Ranging Windows" in either Frame 1, Frame 3, Frame 5, or Frame 7 depending on the distance and the time sequencing or phase difference between Device A and Device B. Using standard ultrasonic time of flight equations modified for the fixed, known, transponder delays, Device A can compute the two-way total time of flight for the transmit and response pulses.

In this embodiment, Device A and Device B can operate asynchronously with a high probability of detecting each other. However, when they both perform transponder interrogation in the same 120 millisecond windows, the broadcast pulses of each device will likely collide or be completely missed making ranging fail. To ensure the devices remain asynchronous, a random "subframe back off" time of between 0 and 31 milliseconds is added shortly after Frame 8. Note that data is not expected to be received during Frames 2 and 6, creating a noise detector. When this occurs in any device, they perform a second random "frame back off" by adding between 8 and 23 frames to the total period of the transponder interrogation.

Enhanced embodiments: 1. The personnel devices incorporate a modulation scheme such as Phase Shift Keying (PSK) or Quadrature Phase Shift Keying (QPSK) to encode the device ID into the ultrasonic pulses, which would simplify the correlation algorithm. 2. Adding coding to the interrogation and transponder response pulses reduces the effect of environmental noise. Noise will not have the coding pattern for the interrogation pulse. This allows transponder devices to minimize responses to non-interrogator ultrasonic signals. Adding different coding to the transponder response pulse allows allow other devices to ignore those ultrasonic pulses. The transponder pulse coding reduces false triggering of transponders when more than two devices are within range.

While this invention has been described in terms of several embodiments, it will be appreciated that those skilled in the art upon reading the preceding specifications and studying the drawings will realize various alterations, additions, permutations and equivalents thereof. Therefore, it is intended that the present invention includes all such alterations, additions, permutations, and equivalents as fall within the true spirit and scope of the invention.

The invention claimed is:

1. A Social Distance Monitoring system comprising: A personnel tracking and monitoring device, a local radio frequency (RF) network, and a monitoring data collection and reporting center that together provide a means to alert personnel of social distancing encroachments and to report encroachment events to a data center for logging and reporting, the personnel tracking and monitoring device consisting of:

(a) A battery power system to power the device while attached to personnel wearer, and (b) A unique identifier for each tracking device, and (c) one ultrasonic transponder, creating a full hemisphere of monitoring coverage, wherein forming a complete hemispherical field of view around one side of each wearer, or optionally two ultrasonic transponders, each creating a full hemisphere of monitoring coverage, wherein forming a complete spherical field of view around each wearer, and (d) a wearable to attach the single ultrasonic transponder to orient it in the preferred direction or two ultrasonic transponders to the wearer in opposing directions, and (e) Combinations of visual, audio, and vibration mechanisms to alert the wearer: (1) That they are involved in a distance violation (encroachment event), (2) Of the state of their device such as: i. awake from sleep, ii. low battery state, iii. power loss pending iv. ultrasonic transponder blocked, and (3) Of a paging message for events such as: v. Shelter in place vi. Evacuate vii. Report to your supervisor, and (f) An RF transceiver to establish a local RF network that is used to: (1) provide RF distance approximations and wearer location utilizing a beaconing methodology (2) report to the data center all distance violations (encroachment events) with the identification of the devices involved and the orientation of the encroachment event (front-to-front, back-to-back, front-to-back}, (3) report the end of an encroachment event to the data center (4) Provide two-way messaging with the data center (g) A variety of sensors, such as: (1) Temperature for environment and wearer, (2) Accelerometer tor wearer-initiated tap-pattern alerting, motion, shock, freefall, tilt, man-down detection, (h) an on-board low power microcontroller to control! the Ultrasonic transponders, RF network, the wearer alerting mechanisms and sensor data processing.

2. Ultrasonic transponders of claim 1 further comprising: (a) two ultrasonic transponders, each creating a full hemisphere of monitoring coverage, wherein forming a complete spherical field of view around each wearer, and (b) Distance measurement algorithms to measure the distance between two (or more); ultrasonic transducers, and (c) Distance measurement algorithms capable of determining the distance between any two tracker devices accurately from zero to seven feet, and (d) Algorithms capable of determining and alerting when any two tracker devices are closer together then the encroachment distance limit (default six feet), and (e) Incorporating a suite of acoustic pulse exchange methodologies to reliably measure the time-of-flight distance between two or more tracker devices and to eliminate false alarms.

3. RF transceiver of claim 1 further comprising: (a) A local RF network that is capable of two-way message transmission, and (b) A local RF network that is capable of performing inter-device RF beaconing and distance measurements, and (c) Data encryption algorithms to encrypt all data message communications to and from the personnel tracking devices.

4. A local RF network of claim 1 further comprising:

(a) A RF gateway device that provides connectivity between the local RF network and the monitoring data collection and reporting center using a wide area network and/or the internet that utilizes a combination of:
  (1) star RF network topology
  (2) mesh RF network topology wherein each network device capable of being a self-provisioning, ad hoc, two-way routing node, and
(b) A two-way messaging protocol that provide direct communications between each personnel tracking and monitoring device and the monitoring data collection and reporting center, and
(c) Data encryption algorithms to encrypt all data message communications between the personnel tracking devices and the data center, and
(d) RF network extender devices to provide a larger local network area, and
(e) A means to provide personnel tracking and monitoring device health monitoring, and
(f) A means to provide software upgrades to the personnel tracking and monitoring device.

5. A monitoring data collection and reporting center of claim 1 further comprising:

(a) A cloud-based multi-processor system, and
(b) Algorithms that correlate the timing of the encroachment events with the RF Beaconing location data to identify the device IDs involved in the encroachment event, and
(c) A database system to log all messages and encroachment events, and
(d) A business operations center interface to report encroachment events and system health to an external business center, and (e) A secure function to manage and protect the association of the device identification with the wearer's identification, and (f) A system to monitor and report the health of each of the fielded personnel tracking devices, and (g) A web-based user interface to monitor and control the data center operations wherein wearer encroachment events are logged and reported to the wearer management in a timely manner.

* * * * *